US006879785B2

(12) United States Patent
Ito et al.

(10) Patent No.: US 6,879,785 B2
(45) Date of Patent: Apr. 12, 2005

(54) IMAGE FORMING APPARATUS HAVING REUSABLE UNIT AND REUSABLE UNIT WITH INDICATOR OF RECORD ON USE

(75) Inventors: Yukihiro Ito, Higashiosaka (JP); Satoru Yonemoto, Sakai (JP); Hideki Kitagawa, Kadoma (JP)

(73) Assignee: Kyocera Mita Corporation, Osaka (JP)

( * ) Notice: Subject to any disclaimer, the term of this patent is extended or adjusted under 35 U.S.C. 154(b) by 27 days.

(21) Appl. No.: 10/382,062

(22) Filed: Mar. 5, 2003

(65) Prior Publication Data

US 2003/0170038 A1 Sep. 11, 2003

(30) Foreign Application Priority Data

Mar. 11, 2002 (JP) ..... 2002-065572

(51) Int. Cl.[7] ..... G03G 15/00
(52) U.S. Cl. ..... 399/24; 399/25
(58) Field of Search ..... 399/9, 24, 25, 399/26, 27, 109, 110, 170

(56) References Cited

U.S. PATENT DOCUMENTS 3,978,379 A * 8/1976 DelVecchio ..... 399/170
4,771,313 A * 9/1988 Kuroda et al. ..... 399/25
4,961,088 A * 10/1990 Gilliland et al. ..... 399/25
5,008,711 A * 4/1991 Sakamoto et al. ..... 399/24
5,101,233 A * 3/1992 Ito et al. ..... 399/24
5,272,503 A * 12/1993 LeSueur et al. ..... 399/25
5,699,091 A * 12/1997 Bullock et al. ..... 399/24
5,877,692 A * 3/1999 Watanabe et al. ..... 399/25
6,347,197 B1 * 2/2002 Maul et al. ..... 399/24
6,512,896 B2 * 1/2003 Asanuma et al. ..... 399/25
6,658,219 B1 * 12/2003 Ito et al. ..... 399/27

FOREIGN PATENT DOCUMENTS

JP 2000-66468 * 3/2000 ..... G03G/15/00

* cited by examiner

*Primary Examiner*—Hoan Tran
(74) *Attorney, Agent, or Firm*—Jordan and Hamburg LLP

(57) ABSTRACT

An image forming apparatus has a unit in which at least an expendable component is incorporated. The unit is reusable by periodically replacing the expendable component. An indicator for indicating a record on use of the unit is attached to a given position on the unit. The record on use can be associated, for example, with one or more of the number of times of re-using the unit, a period lapsed from start of use of the unit, and the total number of times of using the unit with respect to image formation.

21 Claims, 13 Drawing Sheets

IMAGE FORMING APPARATUS HAVING REUSABLE UNIT AND REUSABLE UNIT WITH INDICATOR OF RECORD ON USE

BACKGROUND OF THE INVENTION

1. Field of the Invention

This invention relates to an image forming apparatus and a unit for use therein, and particularly pertains to an image forming apparatus provided with a unit which is incorporated with at least an expendable component and is reusable by periodically replacing the expendable component, and a unit for use in such an image forming apparatus.

2. Description of the Background Art

Generally, image forming apparatus such as copiers and printers are equipped with a variety of expendable components (or consumable items) which are worn out as they are used. It is required to periodically replace these expendable components with new ones. Heretofore, since expendable components are individually replaced one by one, a serviceperson has to check up and adjust a newly installed expendable component so that the newly installed expendable component is normally operated in addition to a replacing operation, which makes the serviceperson's operation cumbersome and complicated.

In view of the above, recently, an idea has been proposed to simplify a replacing operation by assembling expendable components and peripheral parts in vicinity of the expendable components into a one-piece unit as many as possible and by replacing the expendable components as the unit. This idea is very practical in supporting the reuse activity, which has been promoted recently, because the unit is reusable.

Examples of units which are incorporated with an expendable component or components and which are reusable by periodically replacing the expendable component(s) are a charging unit for charging the surface of a photosensitive drum, a developing unit for adhering toner onto an electrostatic latent image which is formed on the drum surface by an optical section to develop the latent image into a toner image, a transferring unit for transferring the toner image onto a sheet, a cleaning unit for removing toner residuals on the drum surface after the image transferring, and a fixing unit for fixing the transferred toner image onto the sheet.

A discharging wire for charging the drum surface, a developer container containing a developer consisting of toner and carriers, and a discharging wire for attracting a toner image formed on the drum surface onto a sheet are some of the examples of the expendable components in the charging unit, the developing unit, and the transferring unit, respectively. Adhesive members which are attached to axially both ends of a cleaning blade and are rendered in pressing contact with the drum surface, and a pair of heating roller and a pressing roller for fixing a toner image on a sheet while passing the sheet in a clearance defined by the roller pair are some of the examples of the expendable components in the cleaning unit and the fixing unit, respectively. The cleaning blade has a contact area with a length not shorter than the maximum width of a toner image producible on the drum surface.

Each unit has its useful life and does not have durability enough to be usable permanently even if the unit is repeatedly recycled and reused, considering its aged deterioration, stress that has been accumulatively exerted on the unit during its use, or other factor. Continued use of such a unit may adversely affect printing quality and sheet transport performance of the image forming apparatus depending on a record or history on use of the unit such as the number of times of reuse, the period lapsed from start of its use, and the total number of times of use with respect to image forming operation.

In view of the above, there is a strong demand for managing the useful life of each unit when the unit is to be reused by grasping the record or history on its use so that the unit may not be used beyond its useful life. Conventionally, however, there has not been taken a specific measure relating to management of the useful life of each unit. It is often the case that a unit is inadvertently used or reused beyond its useful life, which may lead to unstable performance of the image forming apparatus equipped with such a unit.

SUMMARY OF THE INVENTION

In view of the above problems residing in the prior art, an object of this invention is to provide an image forming apparatus equipped with a reusable unit whose useful life is securely managed, and a unit for use in such an image forming apparatus.

According to an aspect of this invention, provided is an image forming apparatus equipped with a unit which is incorporated with at least an expendable component and is reusable by periodically replacing the expendable component, wherein the unit comprises indication means for indicating a record on use of the unit.

These and other objects, features and advantages of the present invention will become more apparent upon reading the following detailed description along with the accompanying drawings.

DESCRIPTION OF THE PREFERRED EMBODIMENTS

Figure 1:
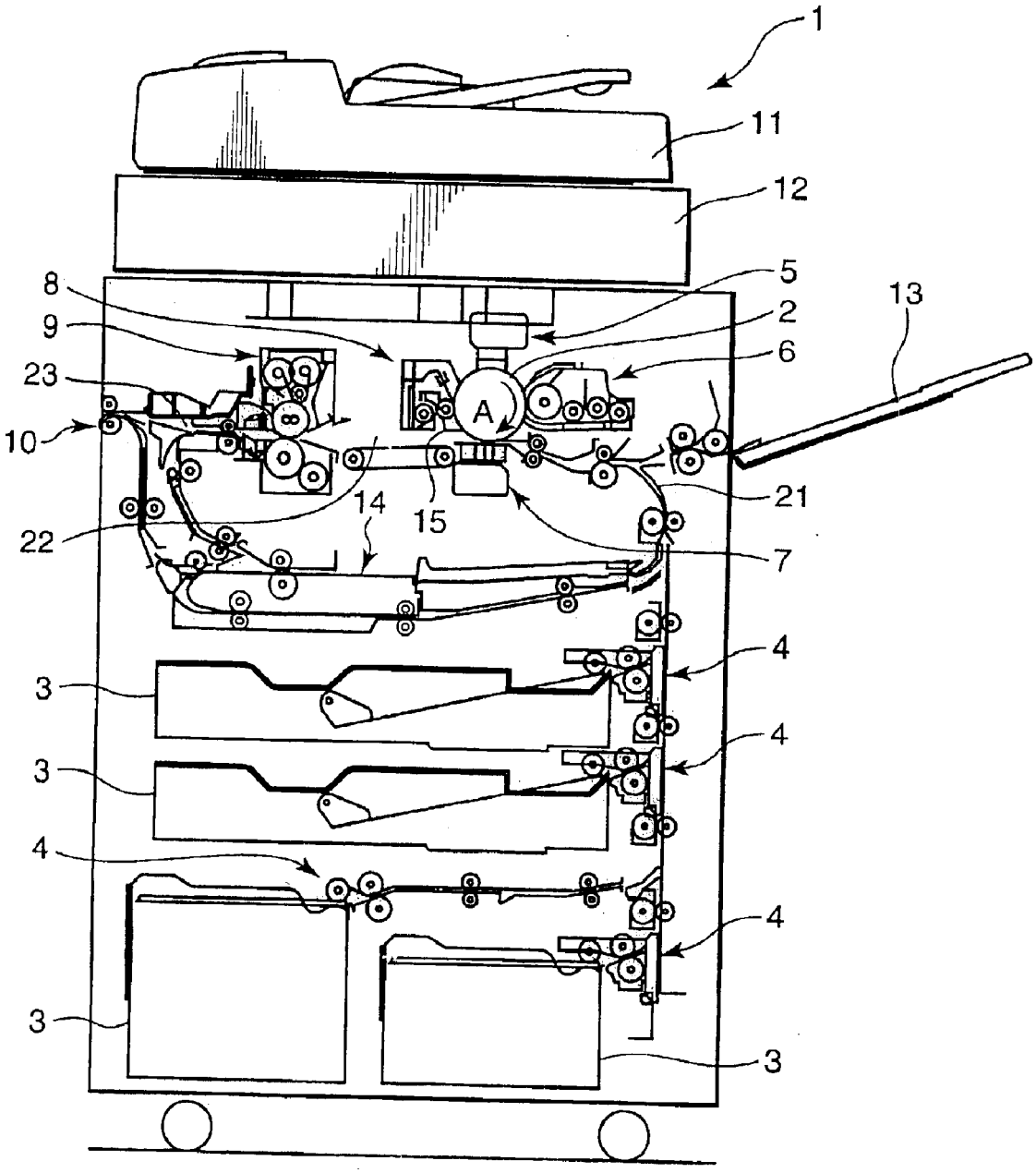
FIG. 1 is a vertical sectional view showing an entire construction of an image forming apparatus in accordance with an embodiment of this invention.
Figure 2:
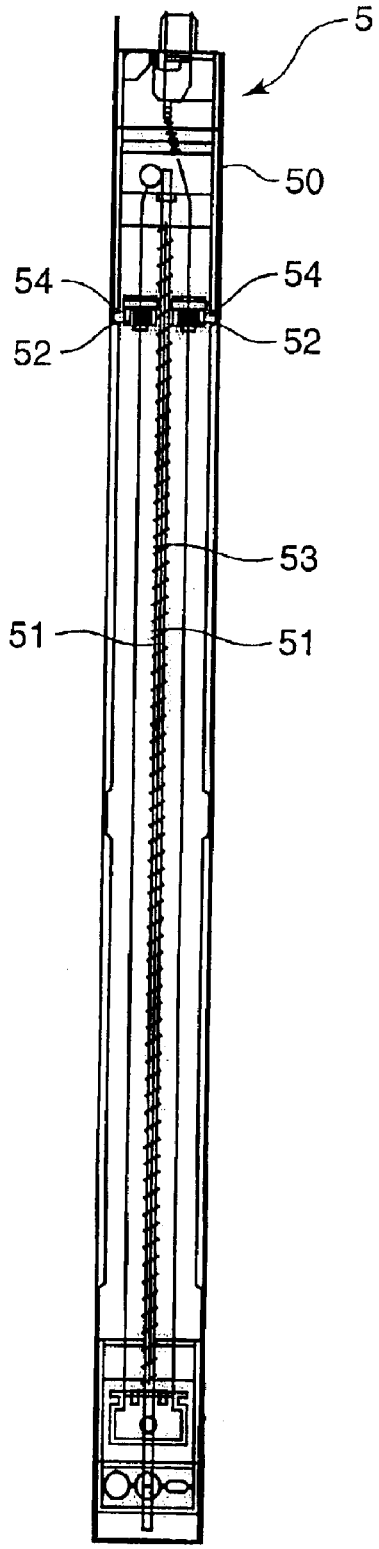
FIG. 2 is a top plan view of a charging unit in FIG. 1.
Figure 3:
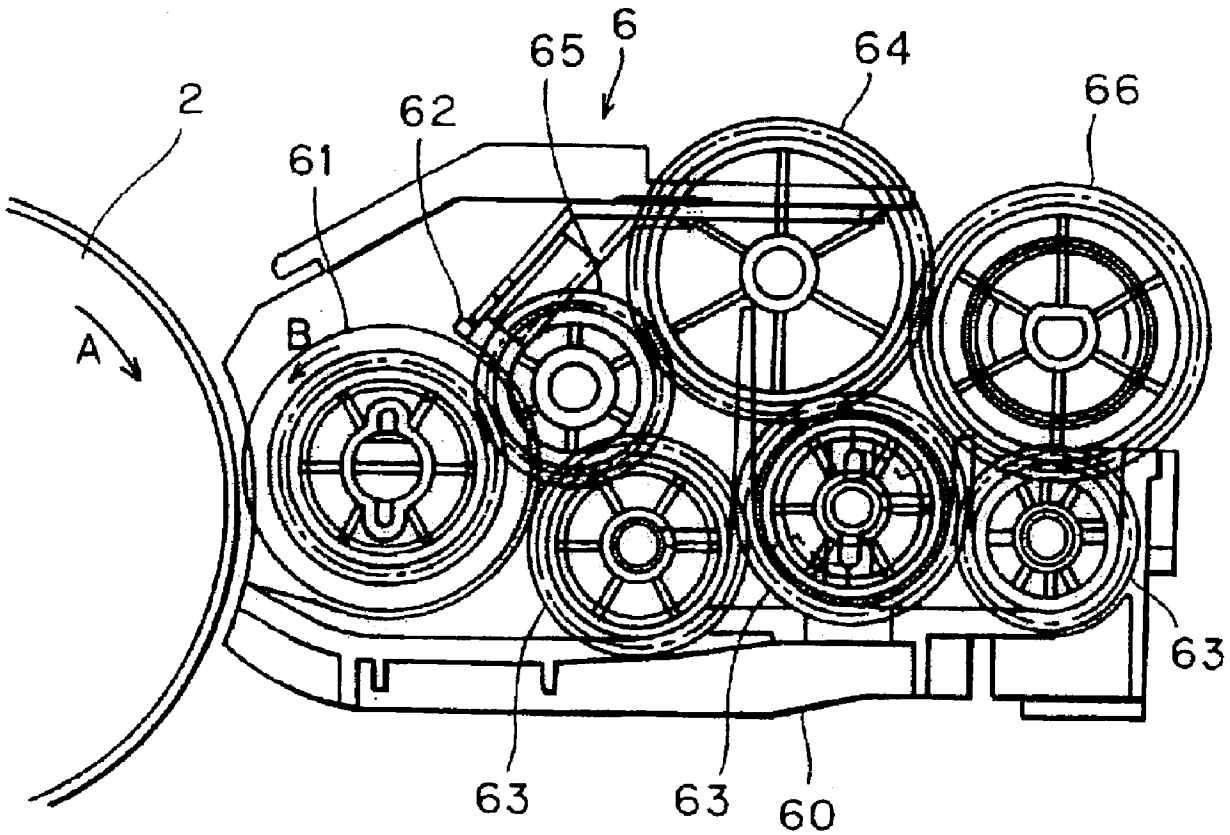
FIG. 3 is an enlarged vertical sectional view of a developing unit in FIG. 1.
Figure 4:
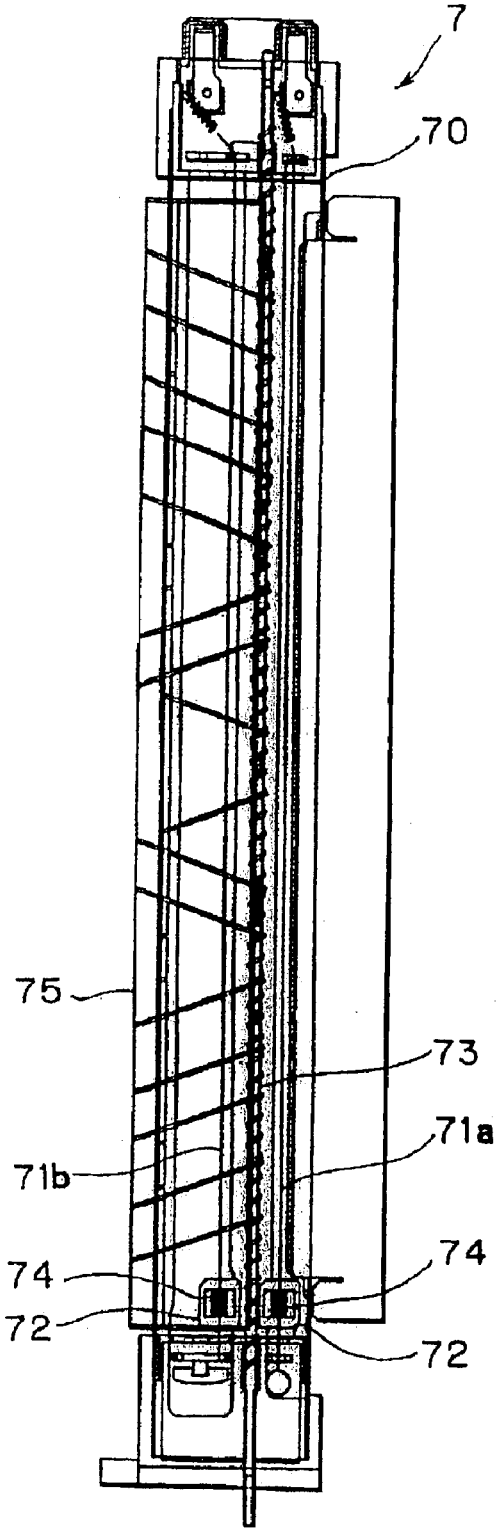
FIG. 4 is a top plan view of a transferring unit in FIG. 1.
Figure 5:
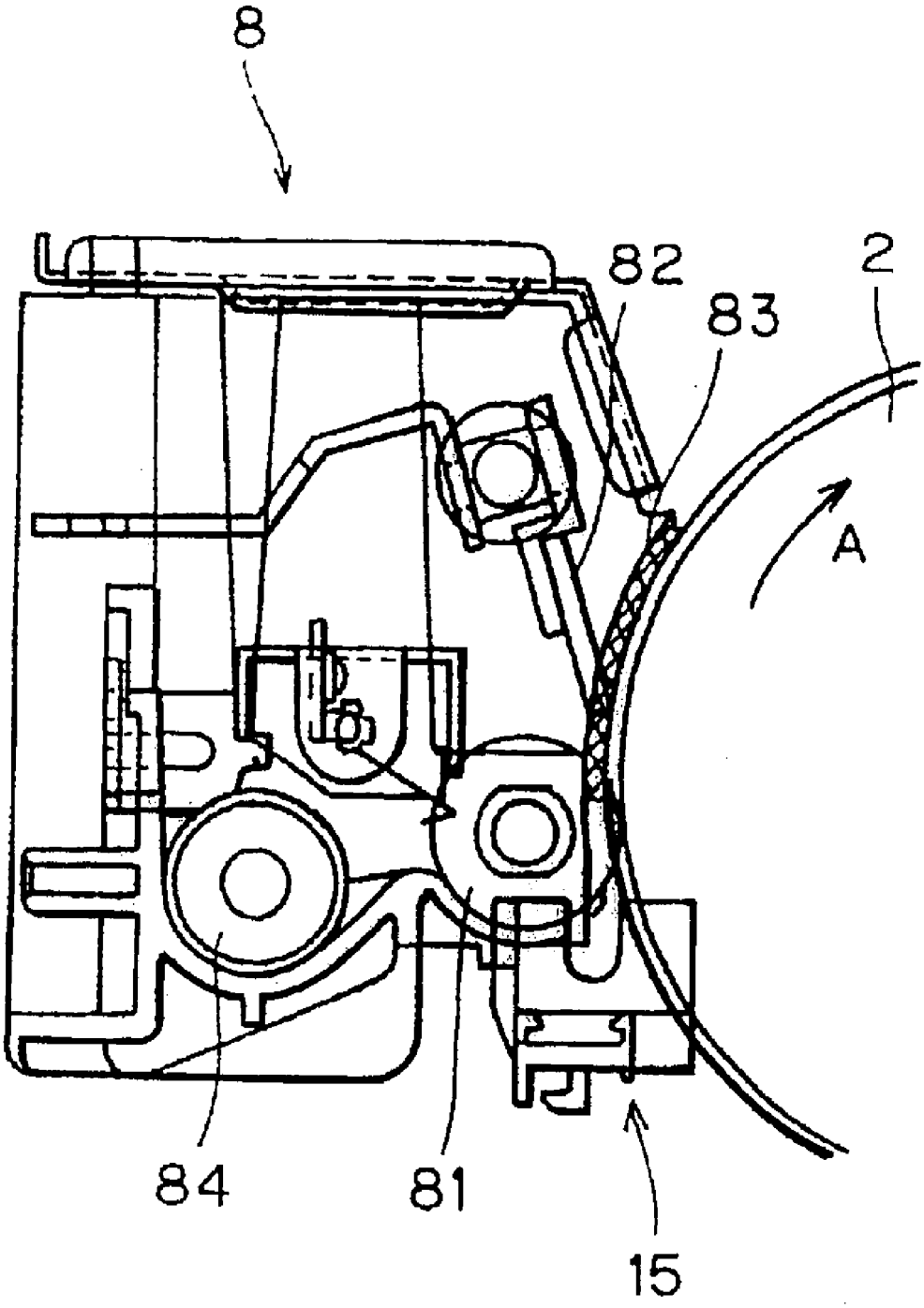
FIG. 5 is an enlarged vertical sectional view of a cleaning unit in FIG. 1.
Figure 6:
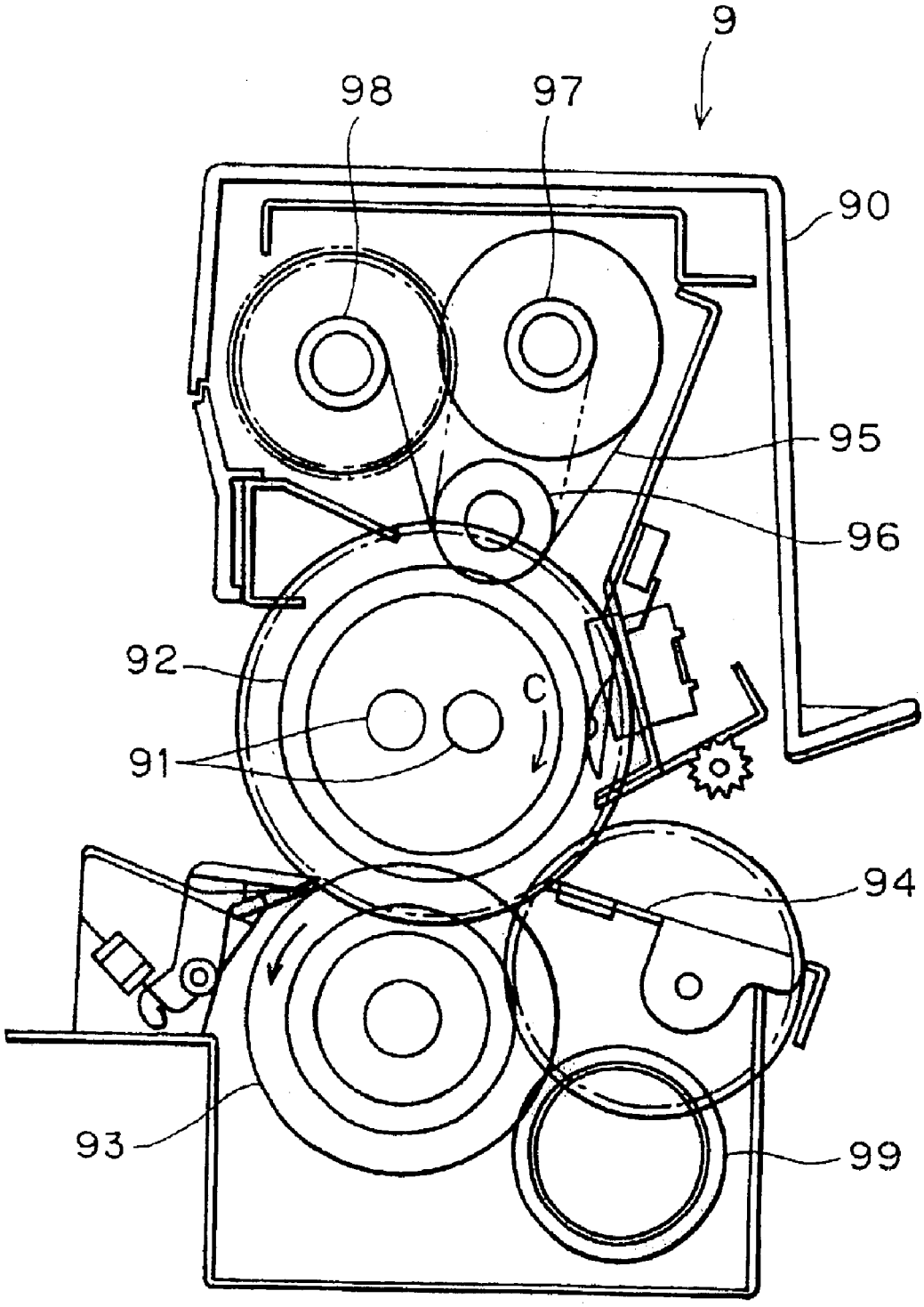
FIG. 6 is an enlarged vertical sectional view of a fixing unit in FIG. 1.
Figure 7:
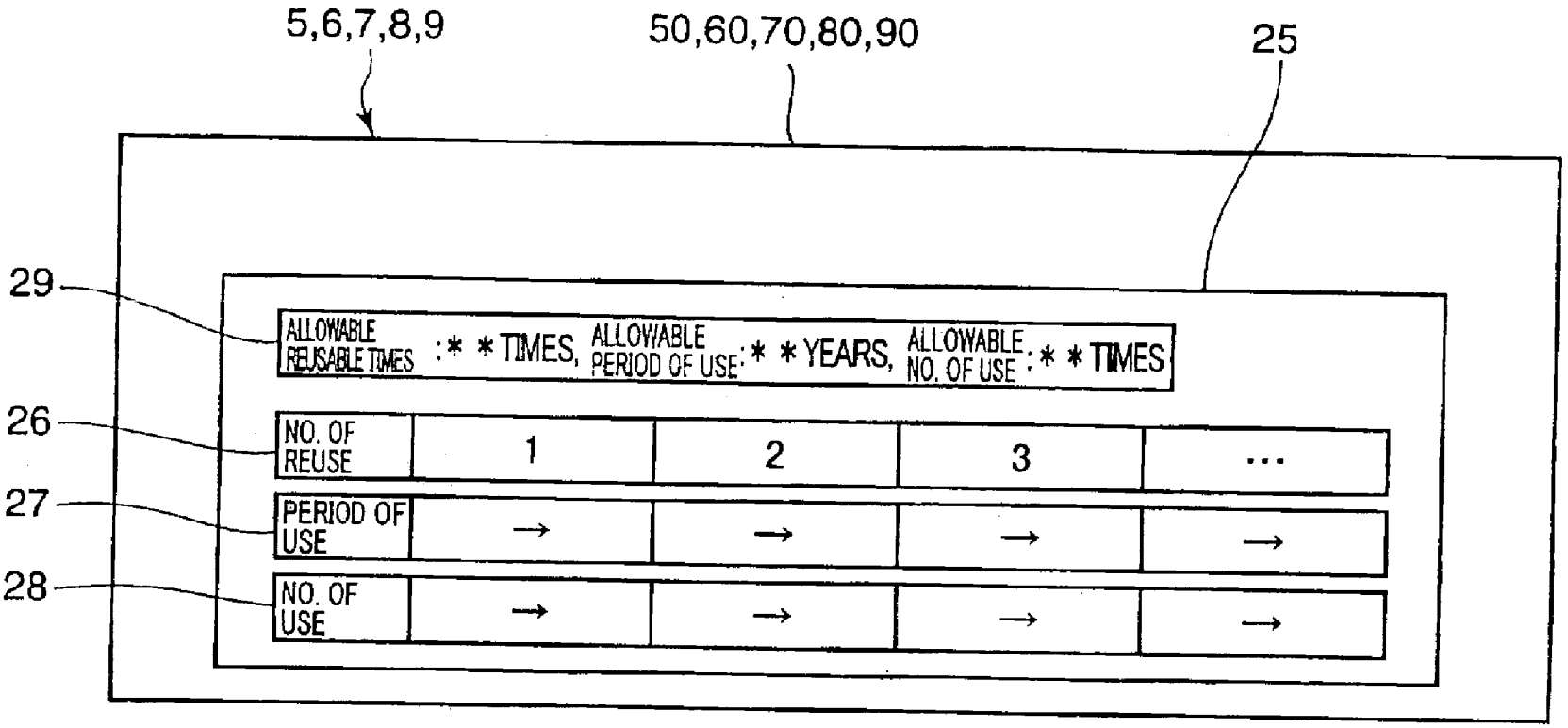
FIG. 7 is a schematic diagram showing an example of indication means to be attached to each unit.

Hereinafter, a preferred embodiment of this invention is described in detail with reference to the accompanying drawings. FIG. 1 is a vertical sectional view showing the entire construction of an image forming apparatus in accordance with an embodiment of this invention. FIG. 2 is a top plan view of a charging unit in the apparatus, FIG. 3 is an enlarged sectional view of a developing unit in the apparatus, FIG. 4 is a top plan view of a transferring unit in the apparatus, FIG. 5 is an enlarged sectional view of a cleaning unit in the apparatus, FIG. 6 is a vertical sectional view of a fixing unit in the apparatus, and FIG. 7 is a schematic diagram showing an example of indication means to be attached to each unit. It should be noted that like elements which have the same function in the drawings are denoted at like numerals.

The image forming apparatus shown in FIG. 1 is a copier for copying an image obtained from a document onto a sheet. The apparatus 1 comprises a photosensitive drum 2 which is rotated in a certain direction (direction shown by the arrow A in FIG. 1), a plurality of sheet cassettes 3 each adapted for accommodating sheets therein, and a sheet feeding unit 4 which is disposed at an upper end position of each sheet cassette 3 for feeding a sheet to the photosensitive drum 2. The apparatus 1 is comprised of a charging unit 5, a developing unit 6, a transferring unit 7, and a cleaning unit 8 which are opposed to the photosensitive drum 2 and are arranged in this order with respect to the rotating direction of the photosensitive drum 2.

The apparatus 1 further comprises a fixing unit 9 for receiving a sheet from the transferring unit 7, a discharge section 10 for receiving the sheet from the fixing unit 9 and for discharging the sheet outside the apparatus 1, a document transporting section 11 which is disposed at an upper part of the apparatus 1 for transporting a document to be copied to a document reading position, and a document reading section 12 which is disposed below the document transporting section 11 for reading an image on the document.

In the above arrangement, a document is transported by the document transporting section 11 to the document reading section 12 where an image on the document is read. While the document image is being read, the surface of the photosensitive drum 2 is uniformly charged by the charging unit 5. Then, the surface of the photosensitive drum 2 is irradiated with light based on the image read by the document reading section 12, by an unillustrated optical section to form an electrostatic latent image on the drum surface. Thereafter, toner is adhered onto the latent image by the developing unit 6 to develop the latent image into a toner image.

Concurrently, a sheet in one of the sheet cassettes 3 is fed to a position between the photosensitive drum 2 and the transferring unit 7 along a sheet feeding path 21 by the corresponding sheet feeding unit 4. Next, the toner image formed on the drum surface is attracted onto the sheet to transfer the toner image onto the sheet. Thereafter, the sheet carrying the transferred toner image is separated from the drum surface, and is transported to the fixing unit 9 via a sheet transport path 22 to fix the transferred toner image onto the sheet. After the image fixation, the sheet is guided along a sheet transport path 23 and is discharged out of the apparatus 1 by the discharge section 10.

After the image transfer by the transferring unit 7, toner residuals on the drum surface are completely removed by the cleaning unit 8. Then, charge residuals on the drum surface are removed by an unillustrated charge removing section comprised of a plurality of light emitting diodes (LEDs). After the removal of the charge residuals, the surface of the photosensitive drum 2 is uniformly charged by the charging unit 5 again to prepare for another image formation. Reference numeral 13 denotes a manual sheet tray, and 14 denotes a switchback section for implementing double-side image formation.

In this embodiment, a number of units are replaceable all at once by taking a measure to extend the useful life of expendable components having a relatively short useful life. Hereinafter the term such as "replace" is used and when it is used in a manner such as "a unit is replaced", this means that a unit is dismounted from an apparatus and an indispensable item of the unit is replaced with a new one and the renewed unit is put back onto the apparatus. By taking such a measure, it is expected that the image forming apparatus is continuously operated for 500,000 times (i.e. image formation of 500,000 times) in order to satisfy the demand of the market where demand of bulky copying is strong, as compared with a conventional case where a serviceperson has to replace the unit when image formation has been carried out for about 150,000 times. As a result, the performance of the image forming apparatus as a whole is stabilized. For instance, the charging unit 5, the developing unit 6, the transferring unit 7, the cleaning unit 8, and the fixing unit 9 are each configured into a one-piece unit, in which an expendable component or components having a relatively short useful life is or are incorporated. The expendable components will be described later in detail. A certain measure is taken to extend the useful life of the expendable components in such a manner that the replacing timings of the units are set substantially identical to each other so as to attain the aforementioned demand relating to the maximal total number of times of copying. Hereinafter, the maximal total number of times of copying is simply called as "target value".

The construction of each unit is described in detail. As shown in FIG. 2, the charging unit 5 has a housing 50 defining the outer shape thereof. Two discharging wires 51, 51 parallel with each other are provided in the housing 50 in such a manner that each discharging wire 51 opposes away from the surface of the photosensitive drum 2 by a certain distance. The discharging wire 51 (51) is made of e.g. tungsten, and discharges upon application of a high voltage from a high-voltage power source (not shown) so as to uniformly charge the surface of the photosensitive drum 2.

Generally the discharging wire 51 is an expendable component having a relatively short useful life. The discharging wire 51 rapidly deteriorates because silica or the like deposits on the surface of the discharging wire 51 as discharging is performed repeatedly. In view of this, the housing 50 is provided with a cleaning mechanism for automatically and periodically cleaning the surface of each discharging wire 51 to extend the useful life of the discharging wire 51 namely, in an attempt to attain the aforementioned target value with respect to image formation. A known art may be applicable to the cleaning mechanism. In this embodiment, the cleaning mechanism is comprised of cleaning members 52, 52, a driving shaft 53, and support members 54, 54.

Specifically, each cleaning member 52 is composed of sponge or a like material and reciprocates along the extending direction of the corresponding discharging wire 51 in resilient contact therewith. With this arrangement, the surface of each discharging wire 51 is periodically cleaned.

Further, the driving shaft 53 is rotatable, has a spiral rib thereon, and extends in parallel with the discharging wires 51, 51. Each support member 54 is formed with a spiral groove engageable with the spiral rib of the driving shaft 53 and supports the corresponding discharging wire 51 in resilient contact therewith. The driving shaft 53 rotates in response to driving of an unillustrated motor. Each cleaning member 52 reciprocates along the extending direction of the corresponding discharging wire 51 along with the corresponding support member 54.

Next, as shown in FIG. 3, the developing unit 6 has a housing 60 defining the outer shape thereof. A developer (not shown) consisting of toner and carriers is stored in the housing 60. The housing 60 is internally provided with a magnet roller 61, a blocking member 62, agitating rollers 63, a magnet roller drive gear 64, a driven gear 65, and an agitating roller drive gear 66. The magnet roller 61 is disposed opposingly away from the surface of the photosensitive drum 2 by a small clearance, and is rotated in the direction shown by the arrow B in FIG. 3 so as to magnetically attract the developer onto the surface of the magnet roller 61. The blocking member 62 blocks excessive developer from being attracted onto the surface of the magnet roller 61 in such a manner that the thickness of the developer attracted to the surface of the magnet roller 61 becomes uniform. Each agitating roller 63 has a spiral outer surface for agitating the developer contained in the housing 60. The magnet roller drive gear 64 is coupled to a driving motor (not shown) for rotating the magnet roller 61. The agitating roller drive gear 66 is coupled to a driving motor (not shown) for rotating the agitating rollers 63.

With the above arrangement, the magnet roller 61 magnetically attracts the developer onto the surface thereof while being rotated in the direction shown by the arrow B in FIG. 3 by way of the magnet roller drive gear 64 and the driven gear 65 in response to driving of the magnet roller driving motor. As the developer is attracted onto the surface of the magnet roller 61, the blocking member 62 regulates the thickness of the developer on the roller surface uniformly. Meanwhile, the photosensitive drum 2 is rotated in the direction shown by the arrow A in FIG. 3 as timed with the rotation of the magnet roller 61 to attract toner onto a latent image formed on the drum surface to develop the latent image into a toner image.

The carrier in the developer is generally an expendable component having a relatively short useful life. The coated layer on the surface of the carrier is worn out or abraded as the carrier is repeatedly brought into frictional contact with the agitating rollers 63, with the result that the ability of diffusing toner is deteriorated. In view of this, in this embodiment, several measures are taken to suppress abrasion of the coated layer on the carrier in an attempt to attain the aforementioned target value with respect to image formation, by e.g. increasing the thickness of the coated layer or by forming the coated layer of a material having high rigidity. In this embodiment, the thickness of the coated layer is, e.g. 2 to 2.5 times as large as the conventional layer.

Next, the transferring unit 7 is described with reference to FIG. 4. As shown in FIG. 4, the transferring unit 7 has a metallic housing 70 defining the outer shape thereof. Two discharging wires 71*a*, 71*b* are provided in the housing 70 in such a manner that the discharging wires 71*a*, 71*b* extend parallel with each other and are opposingly away from the surface of the photosensitive drum 2 by a certain distance. The discharging wire 71*a* (71*b*) is made of e.g. tungsten. The discharging wire 71*a* discharges upon application of a direct-current high-voltage from a high-voltage power source (not shown) to charge a sheet passing through a clearance defined by the drum surface and the discharging wire 71*a* with a polarity opposite to the polarity of toner constituting a toner image. Thus, the toner image formed on the drum surface is transferred onto the sheet owing to an electrostatic attracting force. Further, the discharging wire 71*b* discharges upon application of an alternate-current high-voltage from a high-voltage power source (not shown). Thereby, the charges which have been accumulated on the sheet by discharging of the discharging wire 71*a* are swept away, and then, the sheet is separated from the drum surface which is in turn charged with a polarity opposite to the polarity of the discharging wire 71*a*.

The discharging wire 71*a* (71*b*) is generally an expendable component having a relatively short useful life, as is the case with the discharging wire 51 of the charging unit 5. The discharging wire 71*a* (71*b*) rapidly deteriorates as discharging is repeated. In view of this, the housing 70 is provided with a cleaning mechanism for periodically and automatically cleaning the respective surfaces of the discharging wires 71*a*, 71*b* to extend the useful life thereof, namely, in an attempt to attain the aforementioned target value with respect to image formation. Similarly to the charging unit 5, the cleaning mechanism for the transferring unit 7 is comprised of cleaning members 72, 72, a driving shaft 73, and support members 74, 74. A resinous guide member 75 is mounted on the top surface of the housing 70. The guide member 75 is formed with a number of slanting ribs for receiving and transporting a sheet thereon in a stable manner.

Next, the cleaning unit 8 is described with reference to FIG. 5. As shown in FIG. 5, the cleaning unit 8 has a housing 80 defining the outer shape thereof. The housing 80 is internally provided with, a fur brush 81 and a cleaning blade 82 which are in contact with the drum surface in this order with respect to the rotating direction (direction shown by the arrow A in FIG. 5) of the photosensitive drum 2 at a contact area with a length not smaller than the maximal width of a toner image producible on the drum surface. The housing 80 is further internally provided with a pair of wiping members 83, 83 which are attached to axially both ends of the cleaning blade 82 and are rendered in pressing contact with the drum surface. The wiping member 83 (83) has a raised or fluffy surface.

With the above arrangement, after an image transfer, toner residuals on the drum surface are brushed off by the fur brush 81 as the photosensitive drum 2 is rotated, and then scraped off by the cleaning blade 82. At this time, it is highly likely that part of the toner residuals is left un-removed at portions on the drum surface corresponding to the axially both ends of the cleaning blade 82. Such un-removed toner residuals are wiped away by the wiping members 83, 83. Thus, the toner residuals on the drum surface are completely removed.

The wiping member 83 (83) is generally an expendable component which is made of acrylic resin and has a relatively short useful life. Since the wiping member 83 (83) is mounted on the cleaning unit 8 with its bottom surface being adhesively attached to the main body of the cleaning unit 8 and its top surface being pressed against the photosensitive drum 2, the top surfaces of the wiping members 83, 83 are worn out by repeated frictional contact with the photosensitive drum 2, with the result that the toner removability of the wiping members 83, 83 is lowered. Particularly, since the position of the wiping member 83 which is attached to the cleaning unit 8 relative to the photosensitive drum 2 is fixed, the larger the initial thickness of the wiping member 83 is, the greater the pressing force is exerted to the photosensitive drum 2. As a result, abrasion or wear-out of the surface of the wiping member 83 is serious, which accelerates deterioration of the wiping member 83. In view of this, according to this embodiment, the initial thickness of the wiping member 83 is made as small as possible to minimize the pressing force exerted to the photosensitive drum 2 so as to extend the useful life of the wiping member 83, namely, in an attempt to attain the aforementioned target value with respect to image formation.

Toner residuals that have been removed by the fur brush 81 and the cleaning blade 82 are eventually deposited on the inner wall of the housing 80. A spiral toner collecting roller 84 is provided in the housing 80 to collect the toner residuals at a certain location. Reference numeral 15 denotes a charge removing section which is disposed at an upstream side of the wiping members 83, 83 with respect to the rotating direction of the photosensitive drum 2. The charge removing section 15 is provided independently of the cleaning unit 8 and is comprised of a plurality of light emitting diodes (LEDs). The charge removing section 15 serves as a member for facilitating removal of toner residuals by removing charges on the drum surface and keeping excessive electrostatic attracting force from being generated on the drum surface.

Next, the fixing unit 9 is described with reference to FIG. 6. As shown in FIG. 6, the fixing unit 9 has a housing 90 defining the outer shape thereof. The housing 90 is internally provided with a heating roller 92, a pressing roller 93, and a guide plate 94. The heating roller 92 is rotatable in the direction shown by the arrow C in FIG. 6 and is internally provided with a heater 91. The pressing roller 93 is arranged below the heating roller 92 and is rotated along with the heating roller 92 in pressing contact therewith. The guide plate 94 guides a sheet toward a contact portion between the heating roller 92 and the pressing roller 93. With this arrangement, when a sheet carrying a transferred toner image is transported to the contact portion between the heating roller 92 and the pressing roller 93 while being guided thereto by the guide plate 94, the sheet passes the contact portion along with rotation of the heating roller 92 and the pressing roller 93. At the time of passing the contact portion, the toner transferred to the sheet is fused by heat applied thereto in pressing contact of the pressing roller 93 against the heating roller 92, thereby fixing the toner image on the sheet.

The heating roller 92 and the pressing roller 93 are generally expendable components having a relatively short useful life. It is highly likely that toner, dusts, and the like are adhered on the surfaces of the heating roller 92 and the pressing roller 93 as fixing operation is repeated, thereby deteriorating the surface states of these rollers 92, 93. Particularly, deterioration of the heating roller 92 is remarkable since the surface of the heating roller 92 is in direct contact with a toner image. In view of this, the housing 90 is provided with cleaning mechanisms for automatically cleaning the surfaces of the heating roller 92 and the pressing roller 93, respectively to extend the useful life of the heating roller 92 and the pressing roller 93, namely, in an attempt to attain the aforementioned target value with respect to image formation.

Specifically, in this embodiment, the cleaning mechanism for cleaning the heating roller 92 is comprised of a web roller 96, a paper feeder roller 97, and a winding roller 98. The web roller 96 is disposed above the heating roller 92 and is brought into contact therewith by way of a cleaning paper 95. The cleaning paper 95 is wound up in the shape of a drum around the paper feeder roller 97. The winding roller 98 winds up the cleaning paper 95 as the cleaning paper 95 is dispensed from the paper feeder roller 97 by way of the web roller 96. With this arrangement, the surface of the heating roller 92 is cleaned by the cleaning paper 95. The cleaning mechanism for cleaning the pressing roller 93 is comprised of a cleaning roller 99 which is disposed below the pressing roller 93. The cleaning roller 99 has a raised surface which is brought into contact with the pressing roller 93. The surface of the pressing roller 93 is cleaned by the cleaning roller 99.

In this way, worn-out of the expendable components having a relatively short useful life is suppressed, thereby delaying the time required for replacing each unit. As a result, provided is the image forming apparatus in which the maximal total number of times of copying until replacement of the units is required is set substantially at the target value of about 500,000. Further, performance of the image forming apparatus as a whole can be stabilized and the frequency of replacing the units can be lessened by making it possible to replace the units generally at the same timing.

In this embodiment, it is desirable to replace the sheet feeding units 4 generally at the same timing as the aforementioned units 5, 6, 7, 8, and 9. This idea is proposed to reduce the frequency of replacing the units in the image forming apparatus in the aspect of reducing the cost required for replacement. Each sheet feeding unit 4 is incorporated with a feed roller and a pair of transport rollers. Generally, the sheet feeding unit 4 is replaced when the total number of times of copying by the image forming apparatus reaches about 200,000 to 300,000 if the sheet feeding unit 4 is to be replaced independently. Since the frequency of use of each sheet feeding unit 4 is lessened by arranging a plurality of sheet cassettes 3 used in association with the sheet feeding units 4 respectively, it is substantially possible for the image forming apparatus to attain copying of about 500,00 times as the maximal total number of times of copying (target value) without providing a specific arrangement to the sheet feeding unit 4.

Since the units 4, 5, 6, 7, 8, and 9 are installed in the apparatus on the premise that these units are to be recycled and reused, it is important to manage the useful life of each unit so that each unit may not be used beyond its useful life by grasping the record on use of each unit for the purpose of stabilizing the performance of the image forming apparatus. In view of this demand, each unit is provided with indication means for indicating the record on use of each unit.

Examples of the indication means include a sheet member 25, as shown in FIG. 7. The sheet member 25 is adhered on the outer wall of the housing 50 (60, 70, 80, or 90) of each unit 5, (6, 7, 8, or 9) by an adhesive agent or its equivalent. On the surface of the sheet member 25, provided are indication sections 26, 27, 28 in this order respectively indicating the number of times of reuse, the period lapsed from start of use, and the total number of times of use (copying). The information on the indication sections 26, 27, 28 constitute the record on use of each unit.

Normally, a serviceperson dispatched from the manufacturer of the apparatus writes the date of replacement, the counted number of times of copying (operated number of times), etc. on the indication sections 26, 27, 28 with a marker pen or the like when he or she replaces each unit on site where the apparatus is installed. When the units are returned to the manufacturer at a later date, it is judged whether the useful life elapsed with respect to each unit based on the information on the indication sections 26, 27, 28. If it is judged that the useful life has not elapsed, the unit is recycled and reused by replacing and/or adjusting the expendable components. On the other hand, if it is judged that the useful life has elapsed, the unit is discarded.

Judgment as to whether the useful life has elapsed with respect to each unit is made depending on the specifications defined with respect to each unit. However, the useful life of each unit can be easily checked and verified by providing a useful life indication section 29 indicating the allowable maximum reusable number of times, the allowable maximum period of use, and the allowable maximum total number of times of use (copying) which are defined respectively with respect to the number of times of reuse, the period lapsed from start of use, and the total number of times of use (copying). For instance, let's assume that the useful life indication section 29 indicates that the allowable maximum reusable number of times: 7 times, the allowable maximum period of use: 5 years, and the allowable maximum total number of times of use: 3,600,000. Then, if either one of the numbers in the indication sections 26, 27, 28 on the unit exceeds the corresponding one of the allowable numbers in the indication section 29, it is judged that the useful life has elapsed with respect to the unit.

The material for the sheet member 25 is not specifically limited. In this embodiment, the sheet member in the fixing unit 9 is made of polycarbonate because the fixing unit 9 requires certain heat resistance. The sheet member in the units 4, 5, 6, 7, and 8 other than the one in the fixing unit 9 is made of polystyrene.

Thus, indicating the record on use of each unit by the indication means allows a serviceperson to securely grasp the record on use of each unit. This arrangement securely provides management on useful life of each unit so that the unit may not be used beyond its useful life, thereby providing stable performance of the image forming apparatus.

Figure 11:
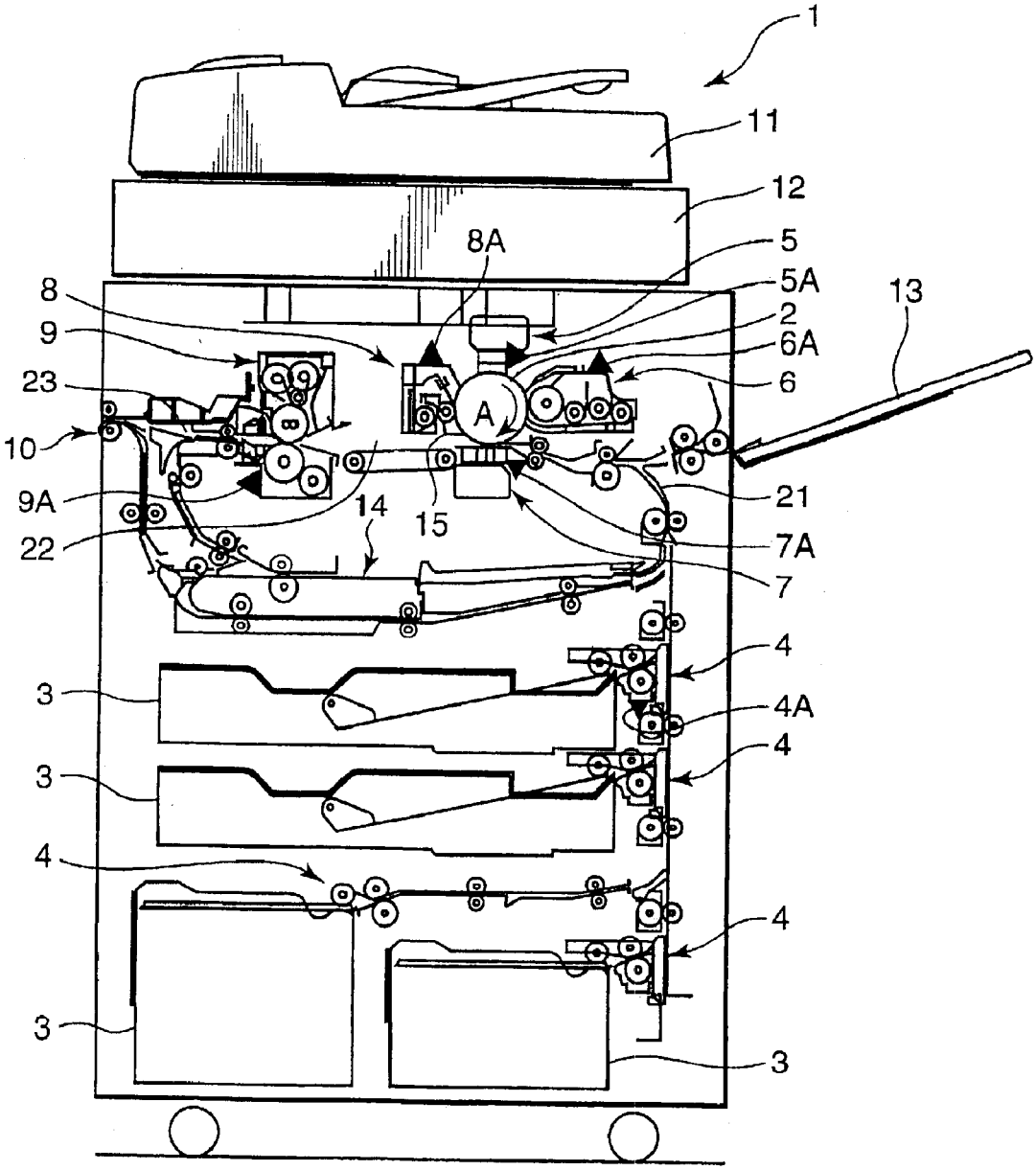
FIG. 11 is a diagram showing a positions of attaching the indication means on respective units.

The position of attaching the indication means (sheet member 25) on each unit are shown in FIG. 11. A triangle with numeral 5*a* indicates the position of attaching the indication means on the charging unit 5. A triangle with numeral 6*a* indicates the position of attaching the indication means on the developing unit 6. Likewise, triangles with numerals 7*a*, 8*a*, 9*a*, and 4*a* indicate the positions of attaching the indication means on the transferring unit 7, the cleaning unit 8, the fixing unit 9, and the sheet feeding unit 4, respectively. However, the aforementioned positions are of some preference, thus this invention is not limited to these indicated positions.

This invention is not limited to the foregoing embodiment, and various modifications and alterations are applicable as far as such modifications and alterations do not deviate from the scope of this invention. For instance, in the above embodiment, the number of times of reuse, the period lapsed from start of use, and the total number of times of copying operations are used as a set of parameters for indicating the record on use of each unit. Alternatively, one of these three parameters may be used as the record on use of each unit, or information other than these three parameters may be used. Further, the number of times of reuse may be expressed in terms of information in the indication section 27 or 28, in place of indication in the indication section 26. In such a case, the maximum allowable reusable number of times for each unit may be indicated in the indication section 27 or 28. Alternatively, the total count values which have been counted with respect to the image forming apparatus at the start time of using each unit and at the end time of using the unit may be indicated in place of the total number of times of copying. Alternatively, the number of times of reuse may be expressed by, e.g. marking out or cutting off a predetermined section or segment one by one each time the unit is recycled and reused. The indication means for indicating the record on use of each unit may be an indicator provided in each unit for automatically counting the number of operated times of each unit, in place of the sheet member 25. Further, the indication means may be attached to a unit or units other than the sheet feeding unit 4, the charging unit 5, the developing unit 6, the transferring unit 7, the cleaning unit 8, and the fixing unit 9.

As an alternative to the indication means mentioned in the above, an electrical indication means for indicating a total number of usage of respective units in terms of the number of copies having been made and a total number of replacing times can be used. In this alternative embodiment, a memory chip such as EEP-ROM (Electrically erasable programmable read only memory) is provided in each of the units 4, 5, 6, 7, 8, 9. The memory chip 4*m* to 9*m* provided in each of the units stores a total number of the usage made "m" of the unit 4–9 in terms of the number of copies (image forming operations) having been made and the number "N" of replacement (reuse) of the unit. The unit information control unit 101 has a plurality of counting sections 1014, 1015, 1016, 1017, 1018, 1019 for counting the number of usages of the respective units 4–9 in terms of the number of copies having been made with respect to the respective units. Note that the term replacement used in this section means that a unit is dismounted from an apparatus and whose indispensable (consumable) part is replaced with a new one and/or cleaned up and then the unit is put back to the apparatus. In addition, when the units 4–9 are mounted back onto the image forming apparatus 1, the memory chips of the units send a signal indicating the replacement of the unit to the respective unit counters (counting sections 1014 to 1019) in the unit information control unit 101 to reset said respective unit counters.

Figure 8:
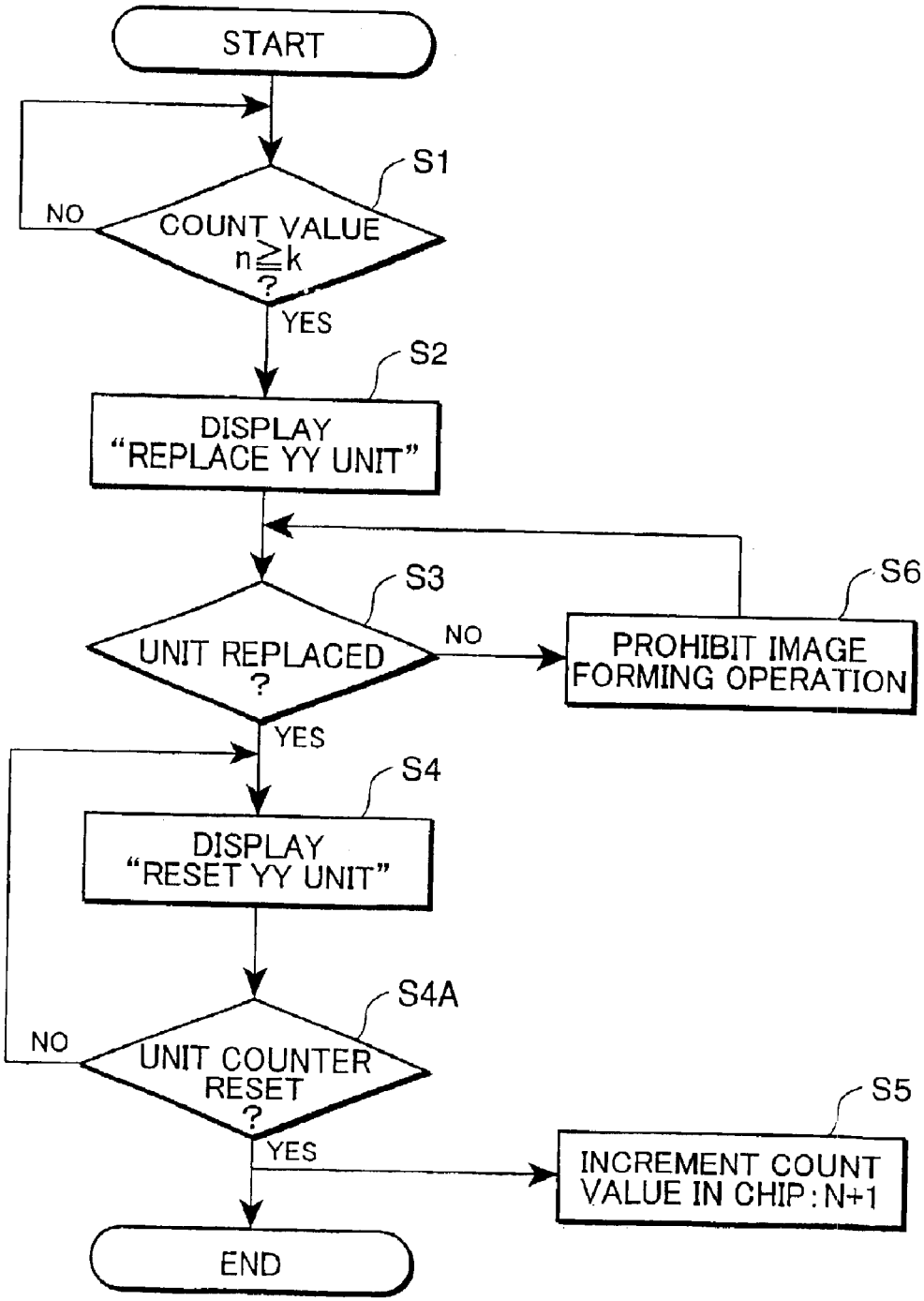
FIG. 8 is a flow chart showing how an electrical indication means works.
Figure 9:
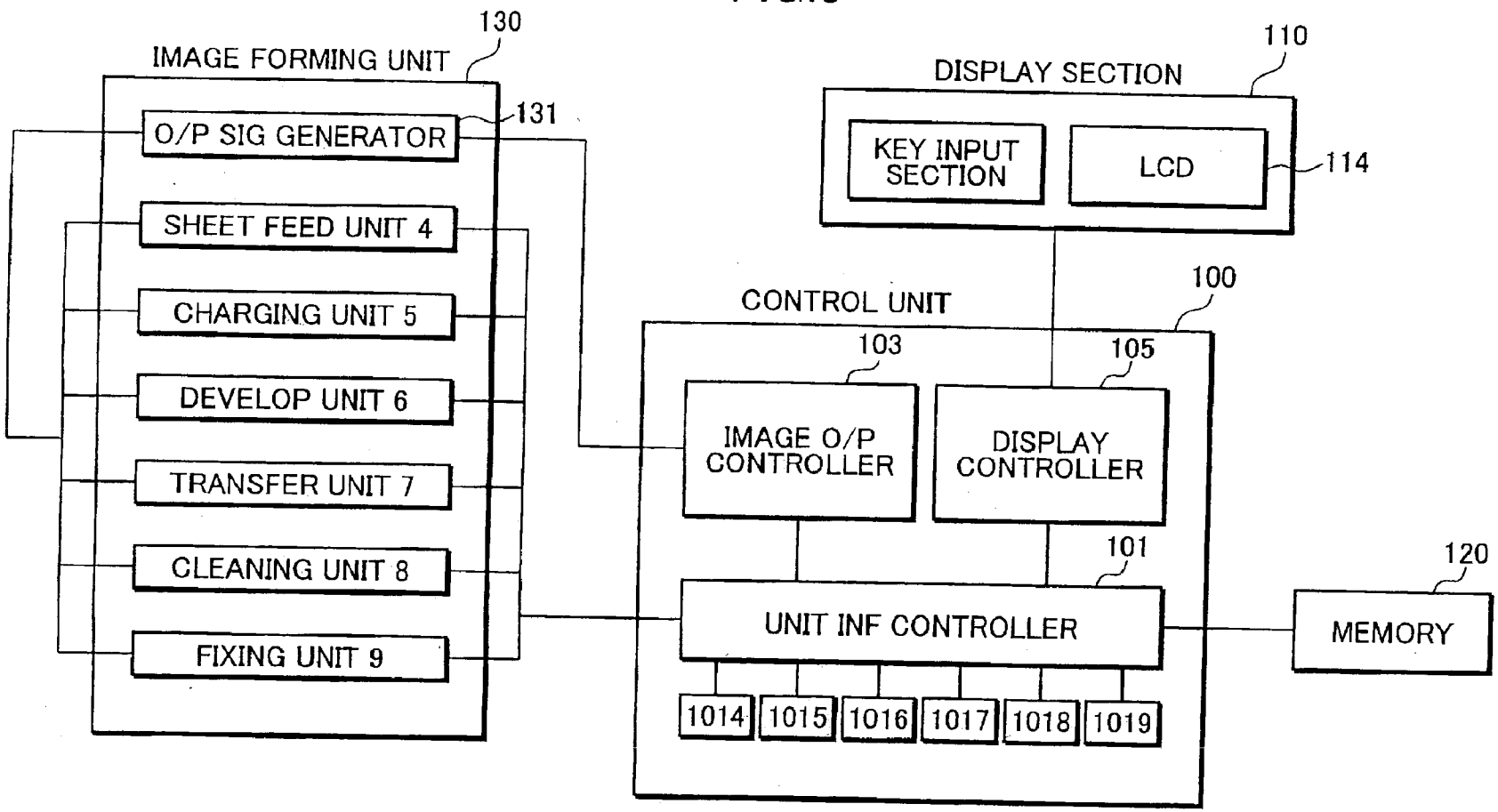
FIG. 9 is a block diagram showing the electrical configuration of the indication means and the relevant units.

More specifically, the aforementioned embodiment is explained with reference to FIGS. 8 and 9 as follows. FIG. 8 shows a flow-chart explaining how the electrical indication means works in time sequence and FIG. 9 shows a block diagram showing control system of the electrical indication means and the relevant controlling units in the system. As mentioned in the above, each of the units, such as a sheet feeding unit 4, a charging unit 5, a developing unit 6, a transferring unit 7, a cleaning unit 8, and a fixing unit 9 is provided with a memory chip 4*m*, 5*m*, 6*m*, 7*n*, 8*m*, 9*m*. Each of the memory chips, 4*m* to 9*m*, is in a state to communicate with an unit information controlling unit 101 in the image forming apparatus 1. The image forming apparatus 1 has an image forming unit 130 and an output signal generation section 131 which generates an output signal when the copy sheet was output from the image forming apparatus 1. When the output signal is generated from the output signal generating section 131, the count value "m" stored in each of the memory chips 4*m*–9*m* of the units 4–9 is incremented by one and at the same time as the signal is transmitted through an image output control unit 103 to the unit information control unit 101, the count values in the counting sections 1014, 1015, 1016, 1017, 1018, 1019 are respectively incremented by one and those incremented values in the counting sections 1014 to 1019 are stored in a memory section 120.

With the aforementioned features of the electrical indication means, the operation thereof is described in accordance with FIG. 8.

In step 1 (S1), if a count value "n" stored in the counting sections 1014 to 1019 reaches a predetermined count value "k" is judged, and then if the judgment result is "yes", the unit information control unit 101 sends a control signal to a display control section 105 to display either one or both of the messages such as "Please replace YY units" and/or "YY units have been used "N" times" on an liquid crystal display section 114 of a display section 110 (S2). Then whether the units are replaced is judged in step 3 (S3). When the units are replaced (Yes in S3), then the message "please reset the unit counters" is displayed on the display section 114 (S4). Then when the unit counters are reset to "0" (Yes in step 4A), then a normal image forming operation can be resumed. Simultaneously, the count value indicating the number of replacement of the unit stored in the respective memory chips 4*m* to 9*m* is to be incremented by one when the units 4–9 are replaced as indicated in step 5 (S5). The timing of incrementing the count value "N" in the memory chips 4*m* to 9*m* can be at the time when the units are dismounted from the apparatus 1 or at the time when the units are fixed (indispensable items are replaced with new ones) and mounted back onto the apparatus 1. In case the units 4 to 9 are not replaced in step 3 ("No" in S3), the control unit 100 may allow several more image forming operations and then prohibit the further image forming operations until the time the unit 4 to 9 are replaced. However for the emergency case such that extra copy is urgently needed for the participants in on-going business meeting, other measure also can be taken to allow further image forming operations even after the allowable copy making times "k" is exceeded. In this case, the warning message that reminds the operator that the machine is only exceptionally allowing such copy making is preferably displayed on the display section 114. Note that we put the numerals 4 to 9 for the units in the above for simplifying the explanation, but it is not meant to limit that the units 4 to 9 are always dismounted and fixed and put back onto the apparatus at the same time. Any combination of the units would be considered to fall into the scope of the present invention as long as more than one unit are replaced at the same time.

Figure 10B:
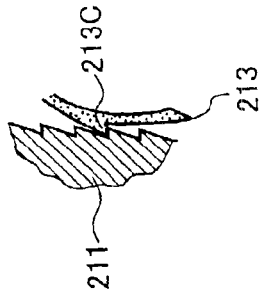
FIGS. 10A to 10D show a mechanical indication means.
Figure 10A:
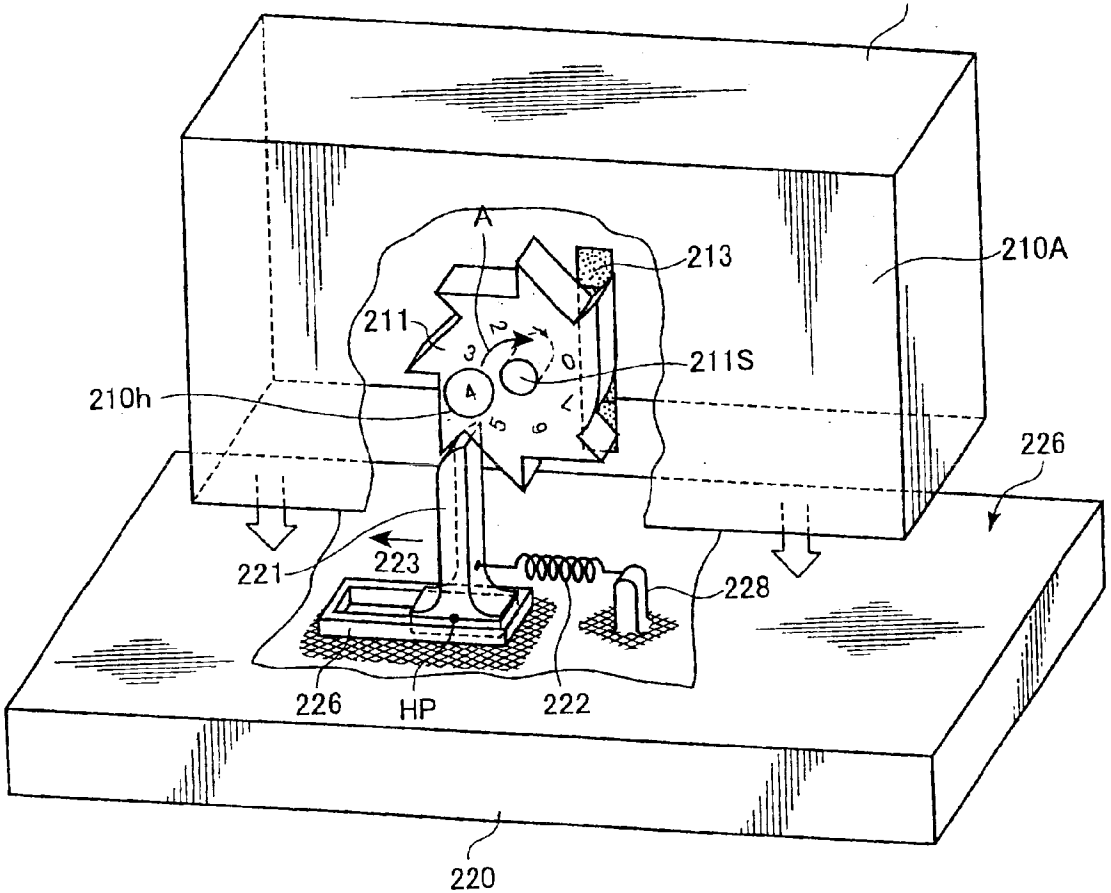
Figure 10C:
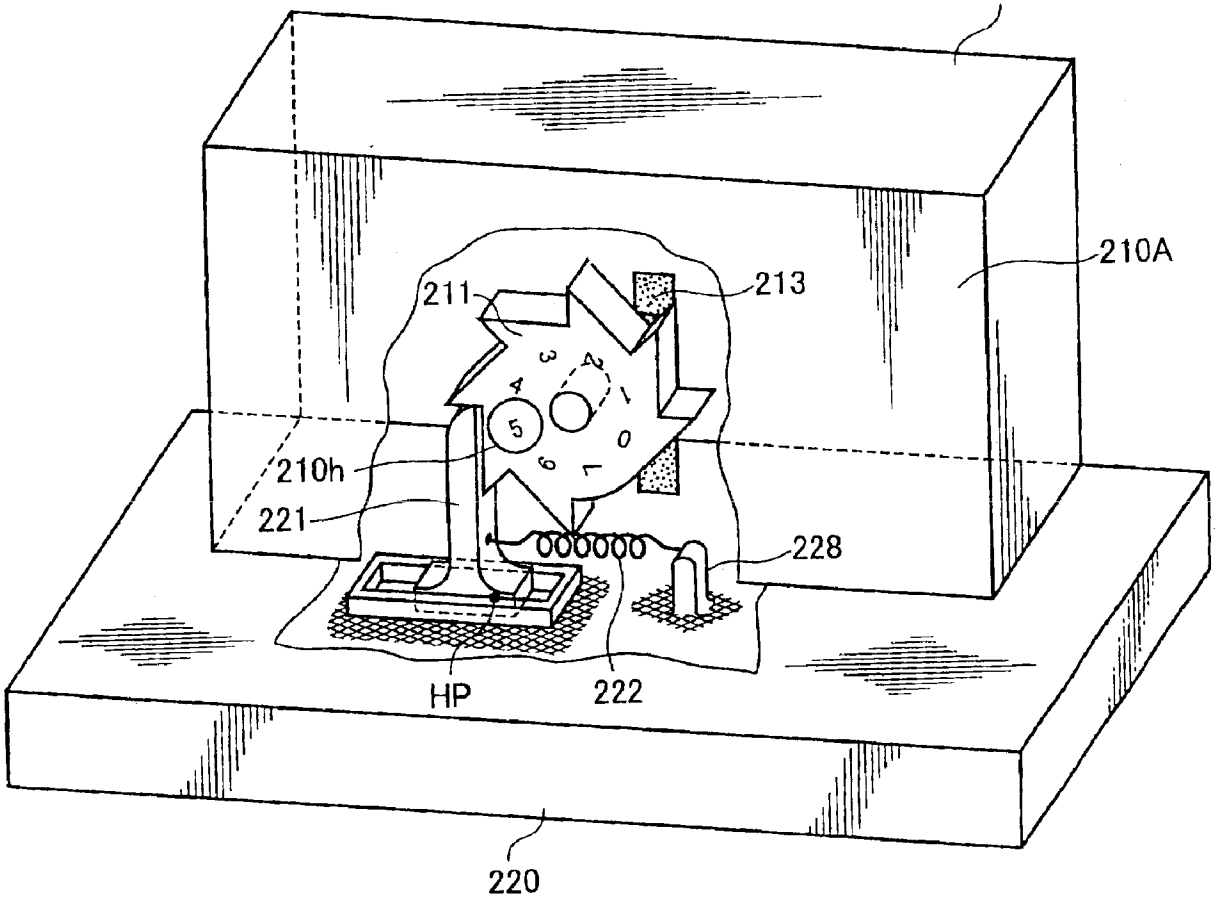
Figure 10D:
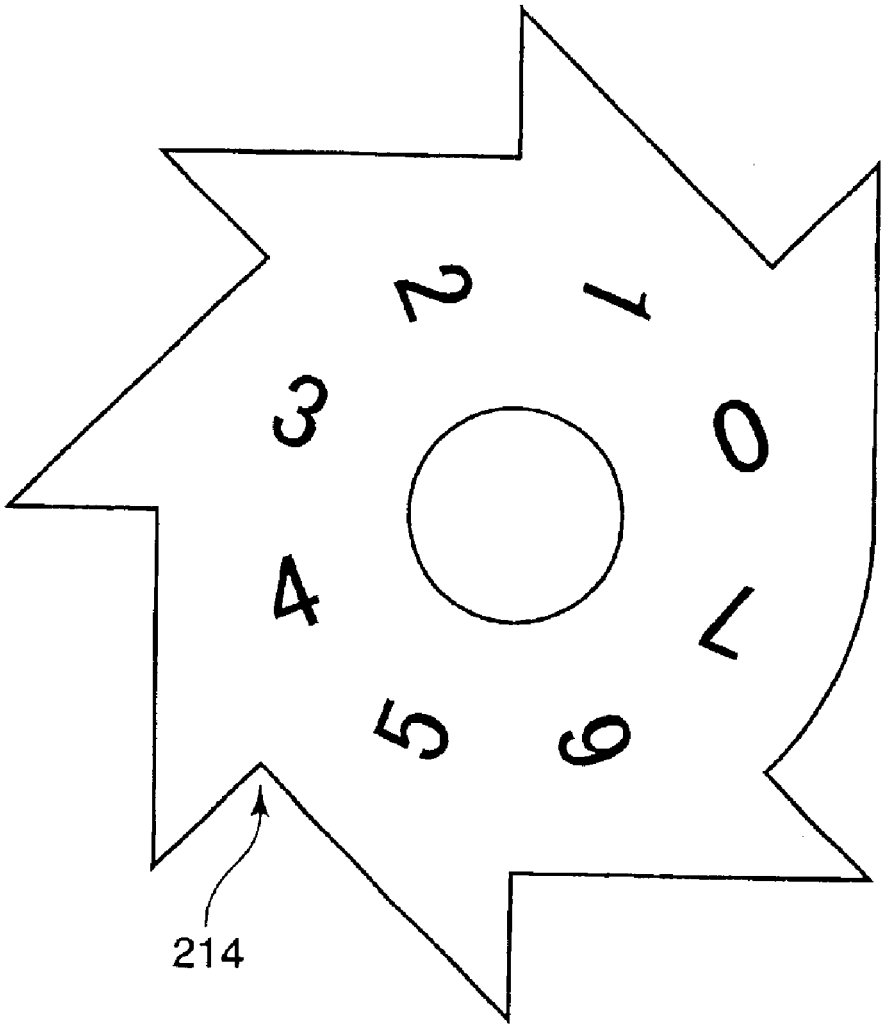

Furthermore, a mechanical type indication means can be provided for indicating the times of replacement of the units 4 to 9. With reference to FIGS. 10A to 10C, taking a fixing unit 10 (210) as an example for an explanation purpose only, a structure of the mechanical type indication means is explained. Needless to say a similar mechanical indication means can be provided to other units. Also note that the figures describe the parts out of proportion for explanation purpose only. For actually reducing to practice, it is understood proper measures need to taken to adequately size the respective parts. An indication member 211 is rotatably provided on an internal side of the side surface 210A of the fixing unit 210 via a shaft 211*s* mounted also on the internal side of the side surface 210A. The rotation of the indication member 211 is restricted in one way by a plate like engaging spring 213 a contact point 213*c* and a saw-like cross sectional shape of the indication member 211 as shown in FIG. 10B. The engagement section of the spring 213 and the side surface of the indication member 211 only allows the indication member 211 to rotate in clockwise direction (in FIG. 10A). The indication member 211, as shown in FIG. 10D, is marked with the numerals 0 through 7 (could be any other integers) which is an indication of the times of the replacement of the unit. A peek hole 210*h* is formed on the side surface 210A of the unit 210 and the position of the peek hole 210*h* is set such that the numeral marked on the indication member 211 can be seen through the peek hole 210*h*. Moreover, a unit mounting portion 220 on the image forming apparatus 1 is provided with an engaging stick 221 which sticks up from the top surface 226 of the unit mounting portion 220 to make an engagement of the indication member 211 when the fixing unit 210 is mounted back on the mounting portion 220. More specifically, the engaging stick 221 is set to be slidable along a guiding member 226 in a left-right direction shown in FIG. 10A and is pulled towards a home position HP via a biasing member such as a spring 222 whose left end is fixed onto the unit mounting portion 220. The home position of the engaging stick 221 is such that a top of the engaging stick 221 makes an engagement with an engageable indent portion 214 of the indication member 211 as indicated in FIG. 10D when the unit 210 is being mounted onto the mounting portion 220 as shown in FIG. 10A. As mounting operation of the unit 210 onto the mounting portion 220 progresses from the state shown in FIG. 10A to the state shown in FIG. 10C, the top end of the stick 211 generates the upward force to the indication member 211 and at the same time the engagement stick 221 is being shifted towards the left direction as indicated with an arrow 223 in FIG. 10A as the engagement state of the engaging stick and the engageable indent portion 214 is being maintained thereby rotating the indication member 211 by a prescribed degree in clockwise direction (indicated with arrow A). As you can see, through the peek hole 210*h*, a number "4" is seen in FIG. 10A and a number "5" is seen in FIG. 10C.

When the unit 210 is dismounted from the mounting portion 220, then the engaging stick 221 is pulled back to its home position (HP) along the guiding member 226 as the engagement state between the stick and the indent portion is released. Thereafter when the unit 210 is fixed and placed back onto its mounting portion 220, the same process is followed so that the indication member 211 is rotated by the prescribed degree in clockwise direction.

As mentioned above, according to an aspect of this invention, provided is an image forming comprising a unit in which at least an expendable component is incorporated and which is re-usable and reusable by periodically replacing the expendable component, wherein indication means for indicating a record on use of the unit is attached to the unit. With this arrangement, when each unit is to be reused in the image forming apparatus, a serviceperson can securely grasp the record on use of each unit and securely manage the useful life of each unit so that each unit is not used beyond its useful life. This arrangement eliminates a likelihood that the unit may be inadvertently used beyond its useful life and secures stable performance of the image forming apparatus.

Preferably, the record on use may be associated with at least one of the number of times of recycling the unit, a period lapsed from start of use of the unit, and the total number of times of using the unit with respect to image formation. With this arrangement, since the record on use of the unit can be managed in association with the useful life of the unit, an on-demand image forming apparatus is provided.

Preferably, the indication means may include a sheet member on which the record on use is indicated. With this arrangement, since the record on use of the unit is clearly indicated on the sheet member, the useful life of the unit is managed with a simplified construction.

Further preferably, in the inventive apparatus, a plurality of the units are provided, each unit is incorporated with an expendable component having a relatively short useful life, and at least one of the plurality of units is equipped with life extending means for extending the useful life of the expendable component so that timings of replacing the expendable components incorporated in the units are set substantially identical to each other.

According to the above arrangement, in the image forming apparatus which is so constructed that all the units are replaceable all at once when the replacing time designated with respect to each expendable component elapses, the units are replaceable all at once by extending the useful life of the expendable components incorporated in the units. As a result, provided is the image forming apparatus with stable performance and with less number of times of replacing the units.

According to yet another aspect of this invention, since the inventive unit is used in any one of the aforementioned image forming apparatus, the unit is used in the image forming apparatus having the aforementioned effects. Thus, provided is the unit which is reusable and whose useful life is securely managed.

This application is based on Japanese patent application serial no. 2002-065572, filed in Japan Patent Office on Mar. 11, 2002, the contents of which are hereby incorporated by reference.

Although the present invention has been fully described by way of examples with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a reusable unit including:

an expendable component, said unit being reusable by periodically replacing said expendable component; and indication means for indicating a record on use of said unit, wherein said record on use is associated with at least one of a period lapsed from start of use of said unit and a total number of times of using said unit with respect to image formation.

2. An image forming apparatus, comprising:

a reusable unit including:

an expendable component, said unit being reusable by periodically replacing said expendable component; and indication means for indicating a record on use of said unit, said record on use being associated with at least one of a number of times of re-using said unit, a period lapsed from start of use of said unit, and a total number of times of using said unit with respect to image formation, said indication means including a sheet member on which said record on use is indicated.

3. An image forming apparatus, comprising:

a reusable unit including:

an expendable component, said unit being reusable by periodically replacing said expendable component; and indication means for indicating a record on use of said unit, wherein a plurality of said units are provided, each said unit is incorporated with the expendable component having a relatively short useful life, and at least one of said plurality of units is equipped with life extending means for extending the useful life of said expendable component such that timings of replacing said expendable components incorporated in said units are set substantially identical to each other.

4. A reusable unit for use in an image forming apparatus, comprising:

an expendable component, said reusable unit being reusable by periodically replacing said expendable component; and indication means for indicating a record on use of said unit, wherein said record on use is associated with at least one of a period lapsed from start of use of said unit and a total number of times of using said unit with respect to image formation.

5. An image forming apparatus comprising:

a) a photosensitive drum (2);

b) a charging unit (5) which is reusable by replacing an expendable component for charging a surface of said photosensitive drum (2), said charging unit including a discharging wire (51) as the expendable component, and first life extending means for extending the useful life of said discharging wire;

(c) a developing unit (6) which is reusable by replacing an expendable component for adhering toner onto an electrostatic latent image formed on the charged surface of said photosensitive drum (2) to develop the latent image into a toner image, said developing unit including second life extending means for extending the useful life of carriers in a developer contained therein;

(d) a transferring unit (7) which is reusable by replacing an expendable component for attracting said toner image formed on the surface of said photosensitive drum (2) onto a copy sheet, said transferring unit (7) including discharging wires **(71*a*, 71*b*) as the expendable component, and third life extending means for extending the useful life of said discharging wires (71*a*, 71 *b*); and (e) a cleaning unit (8) which is reusable by replacing an expendable component for removing toner residuals on the surface of said photosensitive drum (2) after transferring the toner image on the copy sheet by said transferring unit (7), said cleaning unit (8) including a cleaning blade (82) for removing the toner residuals on the surface of said photosensitive drum (2), a wiping member (83) for wiping off the toner residuals that have not been removed by said cleaning blade (82), and fourth life extending means for extending the useful life of said wiping member (83), said wiping member (83) being the expendable component, wherein said first life extending means, said second life extending means, said third life extending means, and said fourth life extending means are so constructed as to set the useful life of each of said discharging wire (51), said carriers, said discharging wires (71*a*, 71*b*) and said wiping member (83) at a predetermined value or more such that said charging unit (5), said developing unit (6), said transferring unit (7), and said cleaning unit (8) are usable until a timing before the useful life of each of said charging unit (5), said developing unit (6), said transferring unit (7), and said cleaning unit (8) exceeds a predetermined value, and such that said charging unit (5), said developing unit (6), said transferring unit (7), and said cleaning unit (8) are replaceable all at once before the useful life of each of said charging unit (5), said developing unit (6), said transferring unit (7), and said cleaning unit (8)** exceeds the predetermined value.

6. The image forming apparatus according to claim 5, wherein said first life extending means includes a cleaning member (52) which reciprocates in an extending direction of said discharging wire (51) in contact therewith, said second life extending means is operative to increase the thickness of a coated layer of said carrier to extend the useful life of said carrier in said developer, said third life extending means includes a cleaning member for cleaning the surface of said discharging wire (71), and said fourth life extending means is operative to minimize an initial thickness of said wiping member (83).

7. The image forming apparatus according to claim 5, further comprising a fixing unit (9), wherein said fixing unit (9) includes a heating roller (92) and a pressing roller (93), and fifth life extending means for extending the useful life of each of said heating roller (92) and said pressing roller (93).

8. The image forming apparatus according to claim 7, wherein said fifth life extending means includes a cleaning mechanism for cleaning the heating roller (92) and a cleaning mechanism for cleaning said pressing roller (93).

9. The image forming apparatus according to claim 5, wherein said charging unit (5) includes a housing (50), and indication means (25) is attached to a given position on said housing (50) to indicate the record on use of said charging unit (5).

10. The image forming apparatus according to claim 9, wherein said developing unit (6) includes a housing (60), and indication means (25) is attached to a given position on said housing (60) to indicate the record on use of said developing unit (6).

11. The image forming apparatus according to claim 10, wherein said transferring unit (7) includes a housing (70), and indication means (25) is attached to a given position on said housing (70) to indicate the record on use of said transferring unit (7).

12. The image forming apparatus according to claim 11, wherein said cleaning unit (8) includes a housing (80), and indication means (25) is attached to a given position on said housing (80) to indicate the record on use of said cleaning unit (8).

13. An image forming apparatus comprising:

a reusable unit including:

an expendable component, said unit being reusable by periodically replacing said expendable component; and indication means for indicating a number of replacement of the reusable unit, said indication means including an indication member having an engageable portion mounted on the reusable unit and an engaging member provided on the side of the image forming apparatus which makes engagement with the engageable portion of the indication member.

14. The image forming apparatus according to claim 13, wherein the indication member is in a form of one-way rotatable member with numerals which advances one by one when the engaging member on the side of the image forming apparatus makes contact with the engageable portion of the indication member when the reusable unit having been dismounted from the image forming apparatus is mounted back onto the image forming apparatus.

15. An image forming apparatus comprising:

an image output signal generator for generating an output signal each time an image forming operation is completed;

a reusable unit including:

an expendable component, said unit being reusable by periodically replacing said expendable component; and a memory chip which receives the output signal from the image output signal generator to update information regarding the times of image forming operations;

a unit information controller which receives the output signal from the output signal generator to update the information regarding the number of times of the image forming operations with the reusable unit;

a display section for displaying the information stored in the unit information controller.

16. The image forming apparatus according to claim 15, wherein the unit information controller controls the display section to display a message indicating the reusable unit needs to be replaced when the information regarding the number of times of the image forming operations stored in the memory chip exceeds a predetermined value.

17. The image forming apparatus according to claim 16, wherein the memory chip stores information indicating the number of replacement of said reusable unit and the stored information is a count value which is incremented by one when the reusable unit is replaced.

18. The image forming apparatus according to claim 17, wherein the unit information controller stores the count value stored in the memory chip of the reusable unit and controls the display section to display a message indicating the reusable unit was replaced by a time corresponding to the stored count value.

19. An image forming apparatus comprising:

a reusable unit including:

an expendable component, said unit being reusable by periodically replacing said expendable component; and indication means for indicating a record on use of said unit, wherein said record on use is associated with a number of times of re-using said unit and a period lapsed from start of use of said unit with respect to image formation.

20. An image forming apparatus comprising:

a reusable unit including:

an expendable component, said unit being reusable by periodically replacing said expendable component; and indication means for indicating a record on use of said unit, wherein said record on use is associated with a number of times of re-using said unit and a total number of times of using said unit with respect to image formation.

21. An image forming apparatus comprising:

a reusable unit including:

an expendable component, said unit being reusable by periodically replacing said expendable component; and indication means for indicating a record on use of said unit, wherein said record on use is associated with a number of times of re-using said unit, a period lapsed from start of use of said unit and a total number of times of using said unit with respect to image formation.

* * * * *